United States Patent [19]

Brownlee

[11] 4,114,299

[45] Sep. 19, 1978

[54] RADIATION POWERED ILLUMINATED DISPLAY

[76] Inventor: Theodore Brownlee, Apt. K-4, 2200 Godby Rd., College Park, Ga. 30349

[21] Appl. No.: 694,702

[22] Filed: Jun. 10, 1976

[51] Int. Cl.[2] ..... G09F 13/00

[52] U.S. Cl. ..... 40/545; 40/591; 340/635; 343/894

[58] Field of Search ..... 325/178, 133, 176; 40/130 H, 129 C, 543, 545

[56] References Cited

U.S. PATENT DOCUMENTS

| | | | |
|---|---|---|---|
| 1,911,234 | 5/1933 | Meyer | 343/823 |
| 2,260,082 | 10/1941 | McCauley | 40/130 H |
| 2,291,467 | 7/1942 | Goldberg | 40/130 H |
| 2,519,302 | 8/1950 | Weincord | 40/130 H |
| 3,411,003 | 11/1968 | Pearce | 40/130 H |

OTHER PUBLICATIONS

The Welch Scientific Company catalog, 1965, (copyright) p. #269.

*Primary Examiner*—Louis G. Mancene
*Assistant Examiner*—Wenceslao J. Contreras
*Attorney, Agent, or Firm*—Newton, Hopkins & Ormsby

[57] ABSTRACT

An illuminated call letter display or sign is bodily mounted on the transmitting antenna of a citizens band radio. An opaque housing contains a fluorescent light tube having electrical contact with the antenna and contains substances which emit light when excited by radiation. Call letters and/or the operator's radio name are displayed on a translucent or transparent panel carried by the housing.

20 Claims, 3 Drawing Figures

RADIATION POWERED ILLUMINATED DISPLAY

BACKGROUND OF THE INVENTION

The dramatic popularity of citizens band (CB) radios in automobiles and other vehicles has given rise to a need for more convenient, effective and attractive means for displaying call or station letters and the operator's name or "handle". At present, haphazard means are employed to accomplish this, such as paper signs pasted on the rear windows of automobiles and various plates or tags attached to vehicles in a variety of unsightly ways. Generally, no means has been made available to illuminate call letters and radio names so that they would be readily visible at night.

The simple object of this invention is to effectively satisfy the above need by providing a very simplified, compact, lightweight and economical illuminating means for the call letters and radio name of CB radios on vehicles. The illuminating device is energized by radio frequency energy from the transmitting antenna and employs a light source containing phosphorescent or like substances which are excited by radiation to emit light. No other energizing source is required. A conventional fluorescent light tube connected to the antenna functions satisfactorily. The displayed indicia is contained on a translucent or transparent panel carried by an opaque housing which carries the illuminating bulb or tube and the housing is bodily supported by the antenna.

Other details and features of the invention will become apparent during the course of the following detailed description.

DETAILED DESCRIPTION

Figure 1:
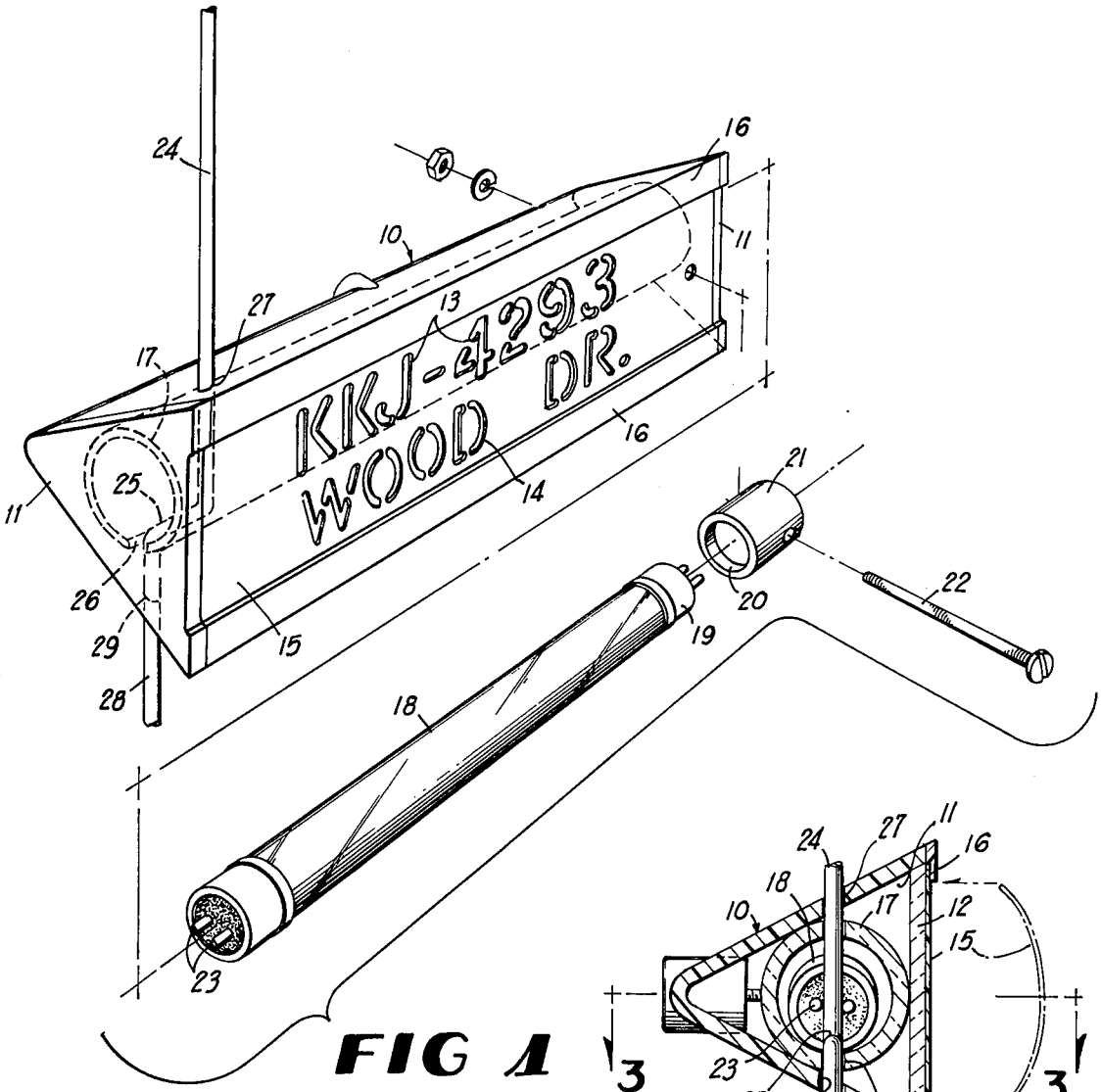
FIG. 1 is an exploded perspective view of an illuminated call letter display embodying the invention.
Figure 2:
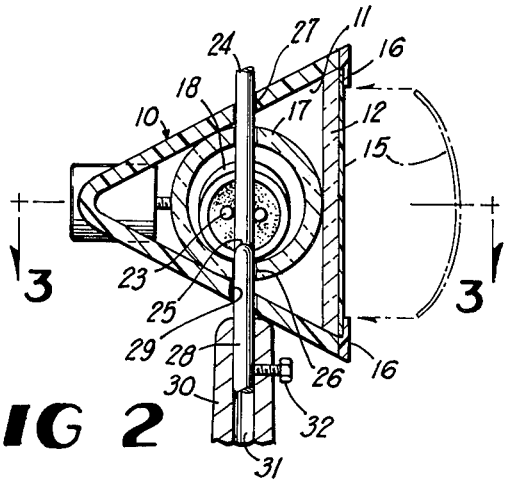
FIG. 2 is a fragmentary transverse vertical section taken through the housing of the device adjacent the supporting antenna.

Referring to the drawing in detail wherein like numerals designate like parts, the numeral 10 designates a preferably black opaque housing formed of plastics or the like which is elongated and approximately V-shaped in cross section in the illustrated embodiment. The opaque housing 10 possesses end walls 11 which may be permanently attached and has a flat transparent or translucent front panel 12 formed of glass or plastics. Preferably, station call letters 13 and the operator's radio name 14 are suitably imprinted on a separate removable and replaceable thin flexible panel 15 formed of transparent or translucent material, such as plastics. The panel 15 may be inserted under a grooved frame member 16 at the front of the illuminating housing as illustrated in FIG. 2. The construction and shape of the housing 10 may vary considerably under the invention and the described arrangement is merely illustrative.

Within the housing lengthwise and extending between the end walls 11 and immediately rearwardly of the panel 12 is a preferably translucent tube 17 which may be colored red or any other preferred color to produce colored light. The tube 17 may be clear if white light is preferred. The tube 17 is preferably in contact with the two converging walls of the housing 10 and the flat panel 12 so that it will be fixed and stable in the housing.

Figure 3:
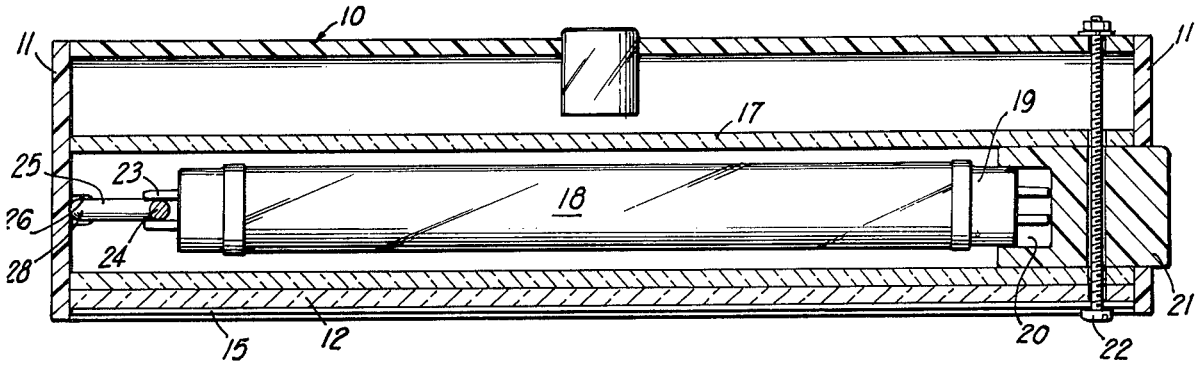
FIG. 3 is a horizontal cross section taken on line 3—3 of FIG. 2.

A conventional fluorescent light tube 18 is received centrally in the tube 17 and spaced therefrom and one end cap 19 of the fluorescent tube is received in a socket recess 20 of a removable plastic end plug 21 which is releasably secured in the housing by a cross screw 22 extending through registering openings in the elements 12, 17, 21 and 10, FIG. 3. Thus, one end of the light tube 18 is firmly supported by the plug 21. The light tube extends for the major portion of the length of the housing, as shown in FIG. 3.

At its other end, the electrical terminals or prongs 23 of the fluorescent tube 18 straddle and engage a transmitting antenna rod 24 of the CB radio and, in this manner, the fluorescent tube is further supported and stabilized in the housing. Below the prongs 23 and adjacent the lower side of translucent tube 17, a lateral shoulder or offset 25 is provided in the antenna rod and this offset is received by a longitudinal slot 26 in the fixed tube 17 which resists rotation of the antenna rod relative to the housing 10 and facilitates assembly. The upper portion of the antenna rod passes through a clearance opening 27 in the upper wall of the housing 10, and similarly the lower offset portion 28 of the antenna rod extends through an opening 29 in the lower side of the housing.

Beneath the housing 10, FIG. 2, the customary post 30 receives the antenna portion 28 within a bore 31 where it may be locked releasably by a set screw 32 or by equivalent means. The post 30 is conventionally adapted for attachment to the trunk lid of an automobile or to any other convenient structure. The lower part of the antenna rod has conventional electrical connection with the CB radio and source of power on the vehicle, not shown.

It should be understood that the illumination of the fluorescent tube 18 is accomplished by the well-known phenomenon of excitation of phosphorescent materials in the light tube by radiation. In the invention, the radiation is radio frequency radiation emitted by the antenna 24 while transmitting. As long as radio transmission is taking place, therefore, the tube 18 will be illuminated and the call letters 13 and other indicia on the panel 15 will be displayed. When transmission is terminated, the light tube will be extinguished automatically and no separate switches or controls for the illuminating means are required. The construction is simple, light and compact and also economical. The antenna rod 24 serves the dual purpose of supporting the call letter illuminated display and of energizing it by radio frequency energy.

It is thought that the advantages of the invention will be recognized by those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An illuminating display for an automobile for indicating when a radio transmitter is being used, comprising: an upstanding transmitting antenna, a housing having an indicia display panel, a light source disposed within said housing, means on said housing for securing said housing to said antenna intermediate the ends of said antenna, said housing being supported by said antenna, said housing projecting sidewise from said antenna, said light source being of the type which is energized and lighted by radio frequency radiation, one end of said light source being disposed adjacent to antenna and the other end thereof being spaced from said antenna so that said antenna constitutes the sole means by which said light source is lighted.

2. An illuminated display as defined in claim 1, wherein said light source is a straight fluorescent light tube having a supportive connection with the housing.

3. An illuminated display as defined in claim 2, and said light tube having an electrical terminal in contact with said antenna at only one end light tube.

4. An illuminated display as defined in claim 3, and said antenna comprising a rod extending into the housing and being straddled by a pair of terminal pins on one end of said light tube.

5. An illuminated display as defined in claim 1, wherein said antenna comprises a rod passing through said housing in close proximity to said light source and supportively engaging the housing.

6. An illuminated display as defined in claim 5, and said light source comprising a fluorescent light element in said housing having terminal means electrically contacting said antenna rod at only one end of said light element.

7. An illuminated display as defined in claim 6, and a colored translucent panel element on the housing between said light element and said indicia display panel.

8. An illuminated display as defined in claim 1, and said transmitting antenna comprising an antenna rod extending into said housing and being bent so as to pass in close proximity to said light source and supportively engaging the housing.

9. An illuminated display for indicia comprising a housing having an indicia display panel, a light source in the housing, and a transmitting antenna coupled with the housing adjacent said light source and forming a support for the housing and emitting radiation energy which energizes the light source so that it emits light, said antenna comprising a rod passing through said housing in close proximity to said light source and supportively engaging the housing, said light source comprising a light element in said housing having terminal means electrically contacting said antenna rod, a colored translucent panel element on the housing between said light element and said indicia display panel, said colored translucent panel element comprising a tube within the housing and surrounding said light element, the light element being a fluorescent light tube, and a removable end plug within said tube having a support socket for one end of said light tube.

10. An illuminated display as defined in claim 9, and a removable fastener element engaged with said end plug and housing and releasably securing the end plug within said tube.

11. The combination with a CB antenna for mounting on an automobile of an illuminated display comprising, a housing, indecia carried by said housing, a light source in said housing, said antenna being in sufficiently close proximity that energy from said antenna generated during normal transmission will light said light source, said antenna supporting both said housing and said light source.

12. The combination as defined in claim 11, wherein said light source is a fluorescent light tube having a supportive connection with said housing.

13. The combination as defined in claim 12, and said light tube having an electrical terminal in contact with said antenna.

14. The combination as defined in claim 13, and said antenna comprising a rod extending into the housing and being straddled by a pair of terminal pins on one end of said light tube.

15. The combination as defined in claim 11, wherein said antenna comprises a rod passing through said housing in close proximity to said light source and supportively engaging the housing.

16. The combination as defined in claim 15, and said light source comprising a fluorescent light element in said housing having terminal means electrically contacting said antenna rod.

17. The combination as defined in claim 16, and a colored translucent panel element on the housing between said light element and said indicia.

18. The combination as defined in claim 17, and said colored translucent panel element comprising a tube within the housing and surrounding said light source, the light source being a fluorescent light tube, and a removable end plug within said tube having a support socket for one end of said light tube.

19. The combination as defined in claim 18, and a removable fastener element engaged with said end plug and housing and releasably securing the end plug within said tube.

20. The combination as defined in claim 11, and said transmitting antenna comprising an antenna rod extending into said housing and being bent so as to pass in close proximity to said light source and supportively engaging the housing.

* * * * *